US008405010B2

(12) United States Patent
Van Dyke et al.

(10) Patent No.: US 8,405,010 B2
(45) Date of Patent: Mar. 26, 2013

(54) PORTABLE MICROWAVE OVEN WITH PROTECTIVE FRAME

(76) Inventors: Bryan J. Van Dyke, Wyoming, MI (US); Jeremy S. Van Dyke, Grand Rapids, MI (US)

( * ) Notice: Subject to any disclaimer, the term of this patent is extended or adjusted under 35 U.S.C. 154(b) by 1175 days.

(21) Appl. No.: 12/289,791

(22) Filed: Nov. 4, 2008

(65) Prior Publication Data

US 2009/0114641 A1 May 7, 2009

Related U.S. Application Data

(60) Provisional application No. 60/996,211, filed on Nov. 6, 2007.

(51) Int. Cl.
*H05B 6/70* (2006.01)
*H05B 6/64* (2006.01)

(52) U.S. Cl. ..... 219/679; 219/757

(58) Field of Classification Search ..... 219/679, 219/681, 682, 756, 757, 762–764, 746–751; 126/21 A, 21 R, 299 R, 299 D; 426/107, 426/241, 242

See application file for complete search history.

(56) References Cited

U.S. PATENT DOCUMENTS

| | | | | |
|---|---|---|---|---|
| D189,279 | S | 11/1960 | Beyrodt | |
| 4,667,075 | A | 5/1987 | Sakurai | |
| 5,237,140 | A | 8/1993 | Akazawa et al. | |
| 5,276,300 | A | 1/1994 | Low et al. | |
| 5,331,128 | A | 7/1994 | Koh | |
| D352,866 | S | 11/1994 | Kindley et al. | |
| 5,369,255 | A | 11/1994 | Sherer et al. | |
| D375,224 | S | 11/1996 | Lilly | |
| D411,407 | S | 6/1999 | Anthony | |
| D425,359 | S | 5/2000 | Seiz | |
| 6,153,870 | A | 11/2000 | Kim et al. | |
| D449,761 | S | 10/2001 | Loftis et al. | |
| 6,392,212 | B1 | 5/2002 | Han et al. | |
| 6,759,636 | B2 | 7/2004 | Stutman | |
| 6,774,567 | B2 | 8/2004 | Jang et al. | |
| 7,645,967 | B2 * | 1/2010 | Kim et al. | 219/756 |
| 2001/0045430 | A1 | 11/2001 | Mawoud | |
| 2004/0060930 | A1 | 4/2004 | Han et al. | |
| 2004/0178195 | A1 | 9/2004 | Kim et al. | |

FOREIGN PATENT DOCUMENTS

| | | |
|---|---|---|
| GB | 2354647 A | 3/2001 |
| JP | 6-68972 | 3/1994 |
| JP | 2000-346368 | 12/2000 |

* cited by examiner

*Primary Examiner* — Quang Van
(74) *Attorney, Agent, or Firm* — Richard C. Litman

(57) ABSTRACT

The portable microwave oven with protective frame is a microwave oven adapted for use in rugged environments, such as a construction site. The portable oven includes a microwave oven and an outer protective frame mounted to the microwave housing. A plurality of connector members are provided, with each connector being mounted on a respective corner of the microwave housing. Each connector is formed from a shock absorbing material. A plurality of support members are further provided, with each support member being mounted to, and joining, a respective adjacent pair of connectors. The support members form the protective frame about the microwave oven and provide a shock-absorbing shield for the microwave oven housing.

20 Claims, 5 Drawing Sheets

PORTABLE MICROWAVE OVEN WITH PROTECTIVE FRAME

CROSS-REFERENCE TO RELATED APPLICATION

This application claims the benefit of U.S. Provisional Patent Application Ser. No. 60/996,211, filed Nov. 6, 2007.

BACKGROUND OF THE INVENTION

1. Field of the Invention

The present invention relates to portable cooking appliances, and particularly to a portable microwave oven with a protective frame adapted for use in rugged environments, such as a construction site.

2. Description of the Related Art

Portable microwave ovens have been used in a wide variety of environments where such a device would be convenient. Portable microwave ovens typically have a similar structure to conventional microwave ovens, but are sized or shaped to be either conveniently carried or conveniently stored in the particular environment or environments in which the user wishes to cook food. Such ovens, although having a shape or size that is well adapted towards portability, still maintain a conventional microwave oven housing structure; i.e., conventional walls formed from metal or plastic, which are designed to withstand typical stresses found in kitchens and other conventional environments. Such microwave ovens are not well adapted to dangerous environments, such as construction sites, where the ovens may be subjected to heavy vibration, accidental blows from tools, falling waste and construction materials, and other injurious shocks and stresses.

Although some microwave ovens have been designed with enhanced stability in mind, such ovens typically include a wall structure having ribs or supports designed to support weight that may be placed on top of the oven. It would be desirable to provide a microwave oven that, in addition to having a stable housing capable of supporting weight, also provides shock-absorbing functionality to absorb accidental shock and strain, thus minimizing damage to sensitive components of the microwave oven. Thus, a portable microwave oven with protective frame solving the aforementioned problems is desired.

SUMMARY OF THE INVENTION

The portable microwave oven with protective frame is a microwave oven adapted for use in damaging or dangerous environments, such as a construction site, where the oven may be subjected to accidental blows from tools and the like, may be subjected to heavy vibration, and may be subjected to the application of severe stress and strain. The portable microwave oven includes a microwave oven and an outer protective frame mounted to the microwave housing. The microwave oven may have a substantially conventional design, including a front door, which is selectively lockable and openable, providing the user access to the interior. It should be noted that the housing of the microwave oven, along with the interior elements of the microwave, are formed from heavy-duty and shockproof materials.

A plurality of connector members are provided, with each connector being mounted on a respective corner of the microwave housing. Each connector is formed from a shock absorbing material. A plurality of support members are provided, with each support member being mounted to, and joining, a respective adjacent pair of connectors. The support members form the protective frame about the microwave oven and provide a shock-absorbing shield for the microwave oven housing.

Further, a handle member is mounted above the upper wall of the microwave oven housing, and is mounted on an upper set of support members. The handle member allows a user to easily transport the microwave oven. In addition, the oven is provided with a rechargeable battery for powering the oven when an external power source is not available. The rechargeable battery is received within a battery port formed in at least one of the sidewalls of the oven. The rechargeable battery may be recharged when the oven is connected to an external power source, such as a conventional AC electrical supply, or the DC outlet of an automobile (such as that commonly associated with a cigarette lighter).

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Now referring to FIGS. 1-5, FIG. 1 illustrates a portable microwave oven system 10 with outer protective frame 14 of the present invention. The portable microwave oven system 10 with outer protective frame 14 is a microwave oven adapted for use in rugged environments, such as, for example, a construction site. The portable microwave oven system 10 includes a microwave oven 12, which may be of substantially conventional design, and an outer protective frame 14, which is mounted to the exterior housing of microwave oven 12. Outer protective frame 14 provides protection from accidental blows, heavy vibration, and excessive stress and strain that might damage the microwave oven 12, such as may be found in rugged environments or during transport of the portable microwave oven system 10.

Figure 3:
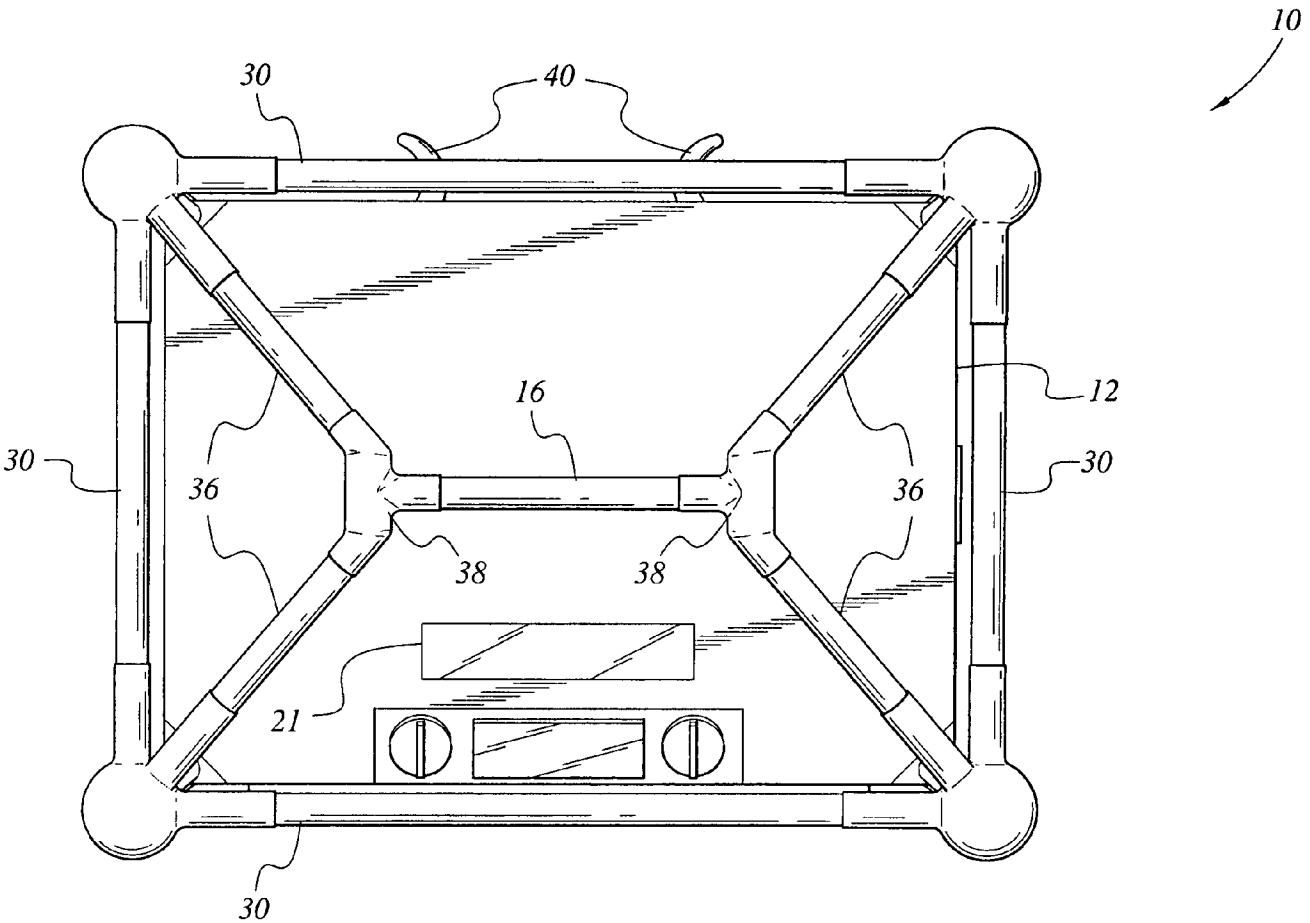
FIG. 3 is a top view of a portable microwave oven with protective frame according to the present invention.
Figure 5:
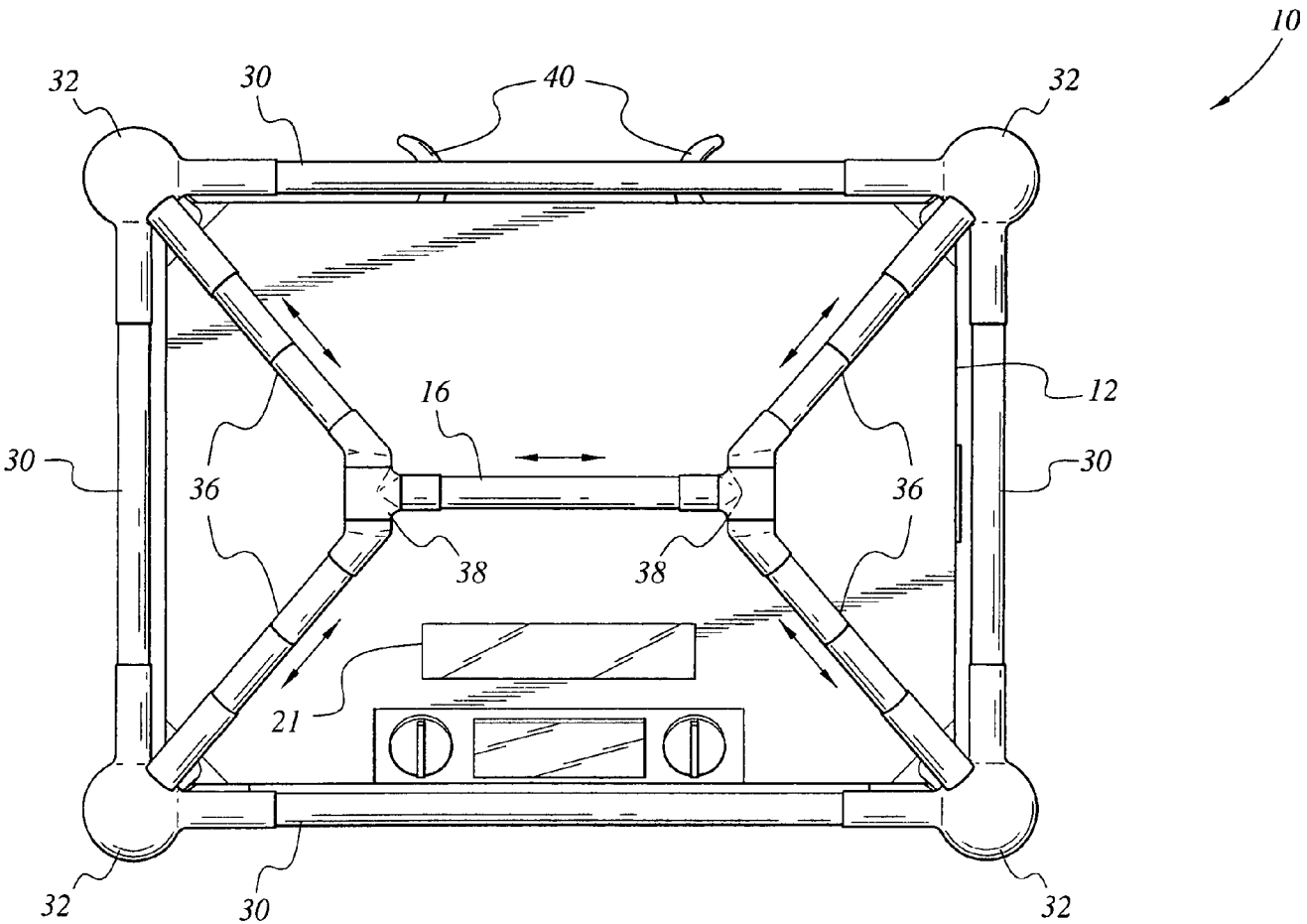
FIG. 5 is a top view of an alternative embodiment of a portable microwave oven with protective frame according to the present invention.

As noted above, the microwave oven 12 may have a substantially conventional design, including a front door 20, which is selectively lockable and openable, providing the user with access to the interior or cooking chamber of microwave oven 12. The interior receives food to be cooked through the application of microwave radiation. The user may observe the cooking process through window 22, which is formed in door 20 and is preferably formed of shatterproof glass or other substantially transparent and shatterproof material. An auxiliary viewing window 21 is also preferably formed in the upper wall of the microwave, as best shown in FIGS. 3 and 5.

A handle member 16 is mounted on the upper end of outer protective frame 14, allowing the user to easily transport the portable microwave oven system 10 to a variety of locations. As will be described in greater detail below, handle member 16 is preferably adjustable, allowing for a user-selectable height and position of the handle. However, as an alternative, the handle member 16 may be formed as a conventional, non-adjustable handle, formed from static and non-adjustable cross members. Further, a control panel 18 is provided along the upper edge of door 20. As shown, the control panel 18 may be mounted within an angled recess, allowing the user to easily view and access the control panel 18 when the portable microwave oven system 10 is positioned on the ground or on the floor.

Figure 1:
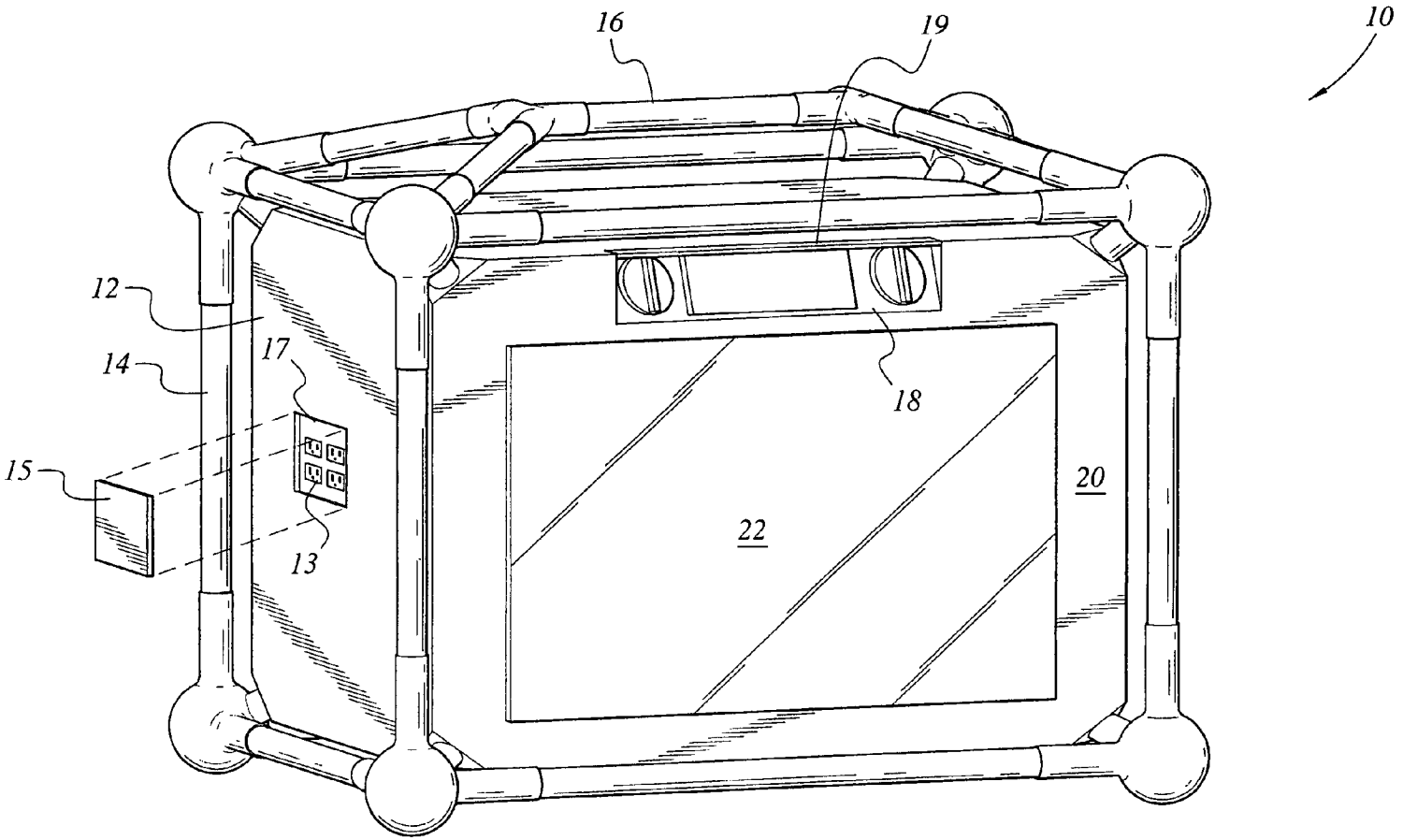
FIG. 1 is a perspective view of a portable microwave oven with protective frame according to the present invention.
Figure 2:
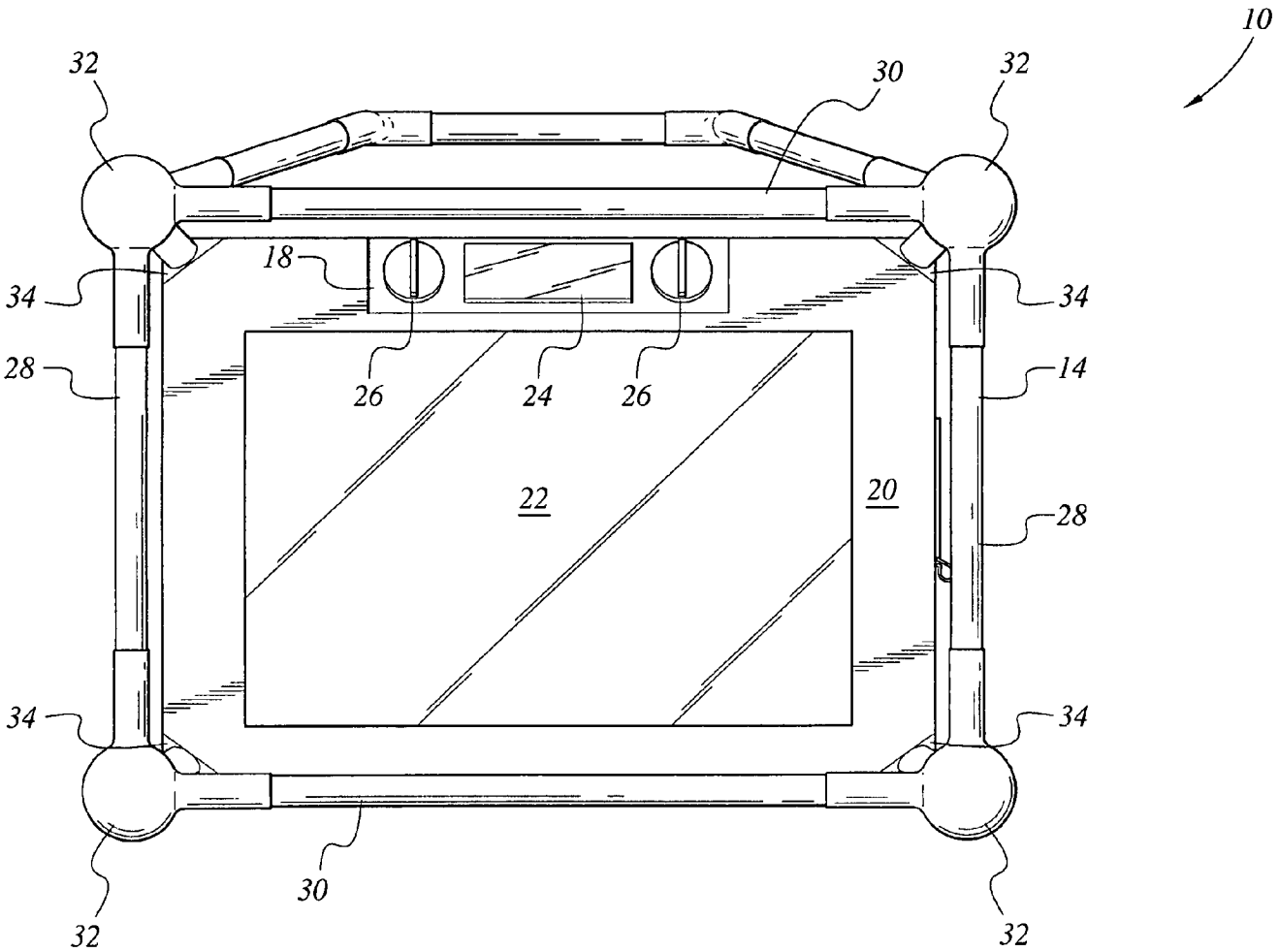
FIG. 2 is a front view of a portable microwave oven with protective frame according to the present invention.

As shown in FIG. 2, the control panel 18 includes a display 24 and a plurality of control dials 26. In the drawings, two such dials 26 are shown, one for control of power output and one for control of cooking time. It should be understood that any number and any type of controls may be used. As further shown in FIG. 2, each corner 34 of the microwave oven 12 is truncated to remove the sharp edge of the corner. This allows the oven 12 to be transported without risk of injury to the user, and further allows for the easy mounting of connectors 32, with one connector 32 being mounted on each corner 34. Each connector 32 is formed from a shock absorbing material, such as hard rubber, preventing damage and injury to oven 12 in dangerous or rugged environments and during transport. Further, as best shown in FIG. 1, a transparent window 19 is provided for covering angled control panel 18. Transparent window 19 may be formed from plastic, shatter-proof glass or the like.

A plurality of horizontal support members 30 and vertical support members 28 form frame 14, as shown. Each support member 28, 30 is mounted between an adjacent pair of connectors 34 in order to form an encompassing, outer protective frame 14 about microwave oven 12. The outer protective frame 14 provides protection for microwave oven 12 from blows, stress and strain, while still allowing the user to access door 20 and control panel 18. Support members 28, 30 may be tubular and are formed from a durable and strong material, such as steel, aluminum or hard plastic. The support members 28 and 30 tubular rods that form a skeletal framework or cage around microwave oven 12 when joined to connectors 32.

As shown in the top view of FIG. 3, a plurality of handle supports 36 are mounted to the upper connectors 32, thus allowing the handle member 16 to be mounted above the upper end of outer protective frame 14. As shown in FIGS. 1 and 2, handle member 16 is mounted slightly above the upper end of outer protective frame 14, allowing the user space to grip handle member 16. Handle member 16 is preferably formed from a similar material to that of support members 28, 30.

A pair of shock absorbing connector members 38, similar to connector members 32, are provided at either end of handle member 16. Connector members 38 join handle member 16 to handle support 36, and also provide shock absorption, preventing injury or damage to microwave oven 12 during transport or from blows, shock or strain. Handle supports 36 similarly provide additional protection for oven 12, may be tubular, and are formed from similar materials to support members 28, 30 and to handle member 16.

Further, as shown in FIG. 3, a pair of hook members 40 are mounted on the upper end of microwave oven 12 along the rear wall 52 thereof. The hook members 40 are provided for the winding and storage of the power cord 54 (shown in FIG. 4) during transport, or when the oven 12 is being powered by battery (as will be described below).

Figure 4:
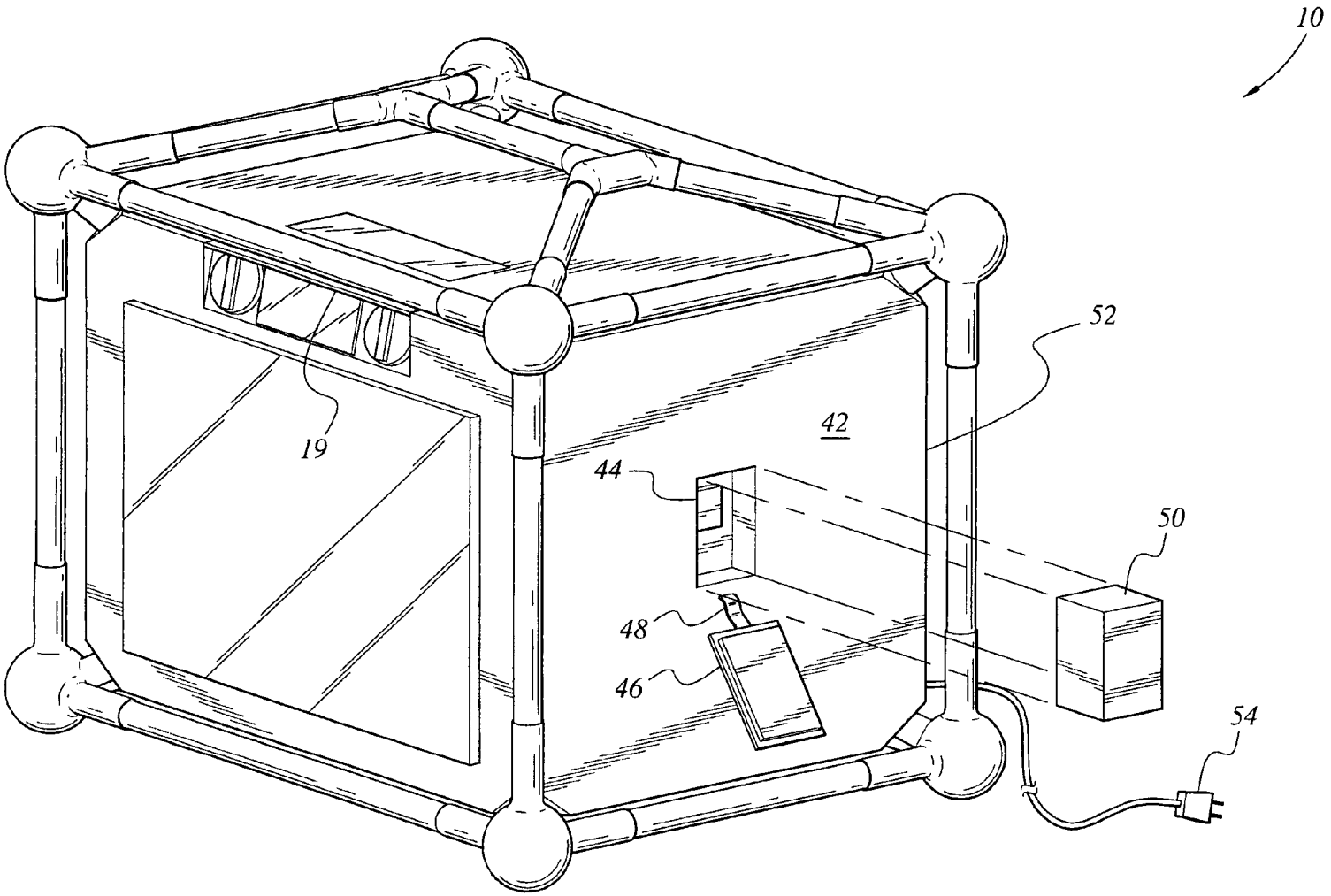
FIG. 4 is a side perspective view of a portable microwave oven with protective frame according to the present invention.

As shown in FIG. 4, the microwave oven 12 is provided with a power cord 54 for connection to an external power source, such as a standard AC wall outlet or receptacle. It should be understood that any suitable power source may be utilized, and the microwave is adapted for receiving any desired form of power, such as, for example, a DC electrical power supply, such as that provided by automobiles and the like. Further, a rechargeable battery 50 is provided for powering the microwave oven 12 during transport or when no external power source is available. A battery port 44 is formed in a sidewall 42 of oven 12 and receives rechargeable battery 50. When not in use, battery port 44 is covered for protection by cover 46, which is mounted to the wall 42 by retainer 48, which may be a cable, chain, plastic strip or the like. Rechargeable battery 50 may power oven 12 on its own when no source of external power is available, and it may be recharged within battery port 44 when cord 54 is connected to a suitable external source of power.

Although shown as being a conventional household AC-style plug, it should be understood that plug 54 may be any desired type of electrical plug, and may be adapted for connection to any desired source of electrical power. For example, plug 54 could be adapted for connection to a source of DC electrical power, such as a power outlet or cigarette lighter outlet provided with power by an automobile car battery, if the microwave oven 12 has internal circuitry designed to operate from a 12-volt dc power supply. Additionally, as shown in FIG. 1, a power port 17 may also be formed in either sidewall, with the power port 17 providing power for charging a rechargeable drill or the like, or providing conventional sockets 13 for powering AC or DC electrical devices, or further providing a ground fault interruption (GFI) receptacle or the like. The additional power port would be powered by either rechargeable battery 50 or through connection of power cord 54 with an external source of power. A removable cover or panel 15 is preferably provided, for releasably sealing power port 17 when not in use. Cover or panel 15 may be releasably joined to the sidewall by threaded fasteners, frictional engagement, or any other conventional means.

As shown in the alternative embodiment of FIG. 5, handle supports 36 and handle member 16 are formed as telescopic rods. Further, handle supports 36 are pivotally joined to upper connectors 32 and connector members 38, thus allowing handle member 16 to have an adjustable length and placement in the horizontal direction, and further to have an adjustable height in the vertical direction; i.e., the handle is retractable (as illustrated by the directional arrows in FIG. 5). It should be understood that any suitable means for adjusting the positioning of handle member 16 may be used. Further, as noted above, the handle may be formed in a non-adjustable, conventional manner.

It is to be understood that the present invention is not limited to the embodiments described above, but encompasses any and all embodiments within the scope of the following claims.

We claim:

1. A portable microwave oven with protective frame, comprising:

a microwave oven having a housing, the housing having opposed upper and lower walls, a pair of opposed sidewalls, a rear wall and a front door, the microwave housing defining an interior chamber for receiving food to be cooked, the housing defining a plurality of corners, the front door being releasably lockable and providing selective access to the interior chamber;

a plurality of corner connector members, one of the connector members being mounted on each of the corners of the microwave housing, respectively, the connector members projecting outwardly and being formed from a shock absorbing material; and a plurality of support members, each of the support members being mounted between and joining a pair of adjacent ones of the corner connector members, the support members forming a supporting and protective frame about the microwave housing.

2. The portable microwave oven with protective frame as recited in claim 1, further comprising a handle member mounted on a top portion of said frame.

3. The portable microwave oven with protective frame as recited in claim 2, further comprising:

a pair of handle connector members, each of the handle connector members being attached to a respective end of said handle member; and a plurality of handle supports, each of the handle supports being attached to and extending between one of the handle connector members and the top portion of said frame.

4. The portable microwave oven with protective frame as recited in claim 3, wherein each said handle support is secured to a respective one said plurality of corner connector members.

5. The portable microwave oven with protective frame as recited in claim 4, wherein said handle member and each said handle support is a telescopic tube.

6. The portable microwave oven with protective frame as recited in claim 5, wherein each said handle connector member is formed from a shock absorbing material.

7. The portable microwave oven with protective frame as recited in claim 1, wherein said microwave oven housing has a battery port formed therein, the portable microwave oven further comprising a rechargeable battery for powering said microwave oven, the battery being releasably received within the battery port.

8. The portable microwave oven with protective frame as recited in claim 7, further comprising a battery port cover for selectively covering and protecting said battery port and said rechargeable battery.

9. The portable microwave oven with protective frame as recited in claim 8, further comprising means for releasably sealing the battery port cover to said microwave oven.

10. The portable microwave oven with protective frame as recited in claim 9, further comprising a power cord electrically connected to said microwave oven for connection to an external source of power to power said microwave oven.

11. The portable microwave oven with protective frame as recited in claim 10, further comprising a power port electrically connected to said microwave oven, the power port having at least one electrical outlet adapted for connection to, and the selective powering of, an external electrical device.

12. The portable microwave oven with protective frame as recited in claim 11, further comprising a power port cover releasably attached to said power port for selectively covering and protecting said power port.

13. The portable microwave oven with protective frame as recited in claim 10, further comprising at least one hook member attached to said microwave oven, the power cord being selectively wound about the at least one hook member when not in use.

14. The portable microwave oven with protective frame as recited in claim 1, wherein each said corner of said microwave oven is beveled.

15. The portable microwave oven with protective frame as recited in claim 1, further comprising an auxiliary window formed in the upper wall of said microwave oven.

16. A portable microwave oven with protective frame, comprising:

a microwave oven having a housing, the housing having opposed upper and lower walls, a pair of opposed sidewalls, a rear wall and a front door, the microwave housing defining an interior chamber for receiving food to be cooked, the housing defining a plurality of corners, the front door being releasably lockable and providing selective access to the interior chamber;

a plurality of corner connector members, each of the corner connector members being mounted on a respective one of the corners of the microwave housing and projecting outwardly therefrom, each of the corner connector members being formed from a shock absorbing material, each of the corners being beveled; and a plurality of horizontal and vertical support members joining a pair of adjacent ones of the corner connector members, the support members forming a supporting and protective frame about the microwave housing.

17. The portable microwave oven with protective frame as recited in claim 16, further comprising a handle member mounted on a top portion of said frame.

18. The portable microwave oven with protective frame as recited in claim 17, further comprising:

a pair of handle connector members, each of the handle connector members being attached to a respective end of said handle member; and a plurality of handle supports, each of the handle supports extending between one of the handle connector members and the top portion of said frame.

19. The portable microwave oven with protective frame as recited in claim 18, wherein each said handle support is secured to a respective one said plurality of corner connector members.

20. The portable microwave oven with protective frame as recited in claim 19, wherein said handle member and each said handle support is a telescopic tube.

* * * * *